US008107658B2

(12) United States Patent
Heerlein et al.

(10) Patent No.: US 8,107,658 B2
(45) Date of Patent: Jan. 31, 2012

(54) HEARING INSTRUMENT WITH PARAMETER RESETTING AND CORRESPONDING METHOD

(75) Inventors: Markus Heerlein, Singapore (SG); Thomas Kasztelan, Erlangen (DE); Bock Swee Joshua Tan, Singapore (SG)

(73) Assignee: Siemens Audiologische Technik GmbH, Erlangen (DE)

( * ) Notice: Subject to any disclaimer, the term of this patent is extended or adjusted under 35 U.S.C. 154(b) by 1127 days.

(21) Appl. No.: 11/980,231

(22) Filed: Oct. 30, 2007

(65) Prior Publication Data

US 2008/0152176 A1 Jun. 26, 2008

(30) Foreign Application Priority Data

Oct. 30, 2006 (DE) ..... 10 2006 051 148

(51) Int. Cl.
*H04R 25/00* (2006.01)

(52) U.S. Cl. ..... 381/323

(58) Field of Classification Search ..... 381/312, 381/323

See application file for complete search history.

(56) References Cited

U.S. PATENT DOCUMENTS

| | | | | |
|---|---|---|---|---|
| 6,240,194 | B1 * | 5/2001 | De Koning | 381/315 |
| 7,974,716 | B2 * | 7/2011 | Schumaier | 700/94 |
| 2002/0071582 | A1 | 6/2002 | Troelsen et al. | |

FOREIGN PATENT DOCUMENTS

DE 42 06 084 C1 12/1992

* cited by examiner

*Primary Examiner* — David Vu
*Assistant Examiner* — Brandon Fox

(57) ABSTRACT

Hearing instruments and in particular hearing aids whose signal processing can be adjusted by the user are to be returned to a defined, individual state in a more convenient manner. For this purpose it is provided that at least one individual, current parameter value for ongoing operation of the hearing instrument is automatically stored in a first memory device. The at least one individual, current parameter value can also be stored manually or automatically in a second memory device. If the user wishes to revert to an earlier setting, he can manually reset the at least one parameter of the hearing instrument to the parameter value stored in the second memory device by actuating a button.

12 Claims, 2 Drawing Sheets

HEARING INSTRUMENT WITH PARAMETER RESETTING AND CORRESPONDING METHOD

CROSS REFERENCE TO RELATED APPLICATIONS

This application claims priority of German application No. 102006051148.4 DE filed Oct. 30, 2006, which is incorporated by reference herein in its entirety.

FIELD OF INVENTION

The present invention relates to a hearing instrument with an adjusting device for varying at least one parameter of the hearing instrument, a first memory device for automatically storing at least one individual, current parameter value for ongoing operation of the hearing instrument, and a second memory device likewise for storing at least one individual, current parameter value. The present invention additionally relates to a corresponding method for adjusting a hearing instrument. The term "hearing instrument" is generally understood here as meaning a portable or non-portable audio device, in particular a hearing aid, a headset or headphones.

BACKGROUND OF INVENTION

Hearing aids are portable hearing instruments for use by the hard of hearing. In order to meet the numerous individual requirements, different hearing aid types are provided, such as behind the ear (BTE) hearing aids, in the ear (ITE) hearing aids, and concha hearing aids. The hearing devices listed by way of example are worn in the outer ear or in the auditory canal. However, bone conduction hearing aids, implantable or vibrotactile hearing aids are also commercially available. In these cases, the damaged hearing is stimulated either mechanically or electrically.

The basic components of a hearing aid are essentially an input transducer, an amplifier and an output transducer. The input transducer is generally a sound receiver, e.g. a microphone, and/or an electromagnetic receiver such as an induction coil. The output transducer is mainly implemented as an electroacoustic transducer, e.g. a miniature loudspeaker, or as an electromechanical transducer such as a bone conduction earphone. The amplifier is usually incorporated in a signal processing unit. This basic design is shown in FIG. 1 using the example of a behind the ear hearing aid. Installed in a hearing aid housing 1 for wearing behind the ear are one or more microphones 2 for picking sound from the environment. A signal processing unit 3 which is likewise incorporated in the hearing aid housing 1 processes the microphone signals and amplifies them. The output signal of the signal processing unit 3 is transmitted to a loudspeaker or earphone 4 which outputs an audible signal. The sound is in some cases transmitted to the wearer's eardrum via a sound tube which is fixed in the auditory canal using an otoplastic. The hearing aid and in particular the signal processing unit 3 are powered by a battery 5 likewise incorporated in the hearing aid housing 1.

The trend of the latest developments is for hearing aids to be increasingly trainable on an individual basis, e.g. for the hearing aid wearer to have ever more interactive control over his hearing aid or rather its adjustment. This creates problems in some circumstances if, because of the large number of adjustment options, the hearing aid wearer loses control of the adaptive adjustments. This can eventually result in the hearing aid being completely out of adjustment.

Patent specification DE 42 06 084 C1 discloses a hearing aid with a means of electronically adjusting a transmission parameter. On the hearing aid there is additionally provided a reset circuit acting on the means of electronically adjusting the transmission parameter. Using this reset circuit, the means can be reset to an initial state (starting position). Such a resetting takes place in particular when the hearing aid's ON/OFF switch is actuated. However, it is also possible for resetting to be initiated when a manually actuatable switch is erroneously operated. This means that the hearing aid automatically reverts to an initial state of the transmission path both in the event of erroneous operation and when it is switched on. Such initial settings are known from other electronic devices and are preset in the factory for particular device types and also stored in a memory provided for that purpose.

SUMMARY OF INVENTION

Hearing aids generally require a time-consuming fitting procedure in which the hearing aid's numerous parameters are matched to a patient's hearing damage or requirements on an individual basis. Resetting to a factory preset may therefore mean a major loss. In some cases the hearing aid wearer has to undergo the entire fitting procedure again.

The object of the present invention is therefore to make the adjustment of a hearing instrument more convenient and more reliable.

This object is achieved according to the invention by a hearing instrument with an adjusting device for varying at least one parameter of the hearing instrument, a first memory device for automatically storing at least one individual, current parameter for ongoing operation of the hearing instrument and a second memory device different from the first memory device for storing the at least one individual, current parameter value, as well as an actuating device for manually initiating storing of the at least one parameter value in the second memory device and a resetting device for manually resetting the at least one parameter to the parameter value stored in the second memory device.

Additionally provided according to the invention is a method for adjusting a hearing instrument by varying at least one parameter of the hearing instrument and automatically storing at least one individual, current parameter for ongoing operation of the hearing instrument in a first memory device, as well as storing the at least one individual, current parameter value in a second memory device different from the first memory device and manually resetting the at least one parameter to the parameter value stored in the second memory device.

The inventive storing of an individual setting either after a professionally performed individual fitting procedure or after a positively experienced fine adjustment performed by the hearing aid wearer himself serves as a kind of safety net for a trainable hearing aid or a correspondingly trainable hearing instrument.

Basically the resetting device can have a switch or button with which a so-called "hard reset" can be implemented. Such a reset is generally always possible even when the software is in an undefined state.

However, the resetting device can also have a plurality of keys (e.g. remote control), and resetting is performed by means of a key combination under software control, thereby providing a so-called "soft reset" which can be implemented from defined software states.

According to another embodiment, the resetting device has a button which is pressed for a specified minimum time for resetting. In particular the program button of a hearing instrument can be used for this purpose. This has the advantage that no special control, i.e. button or switch, needs to be provided on the hearing instrument for resetting.

The memory devices are preferably implemented using an EEPROM or dual EEPROM, thereby enabling the memories to be overwritten as required.

BRIEF DESCRIPTION OF THE DRAWINGS

The present invention will be explained in greater detail with reference to the accompanying drawings in which.

DETAILED DESCRIPTION OF INVENTION

The example described in greater detail below constitutes a preferred embodiment of the present invention.

Figure 1:
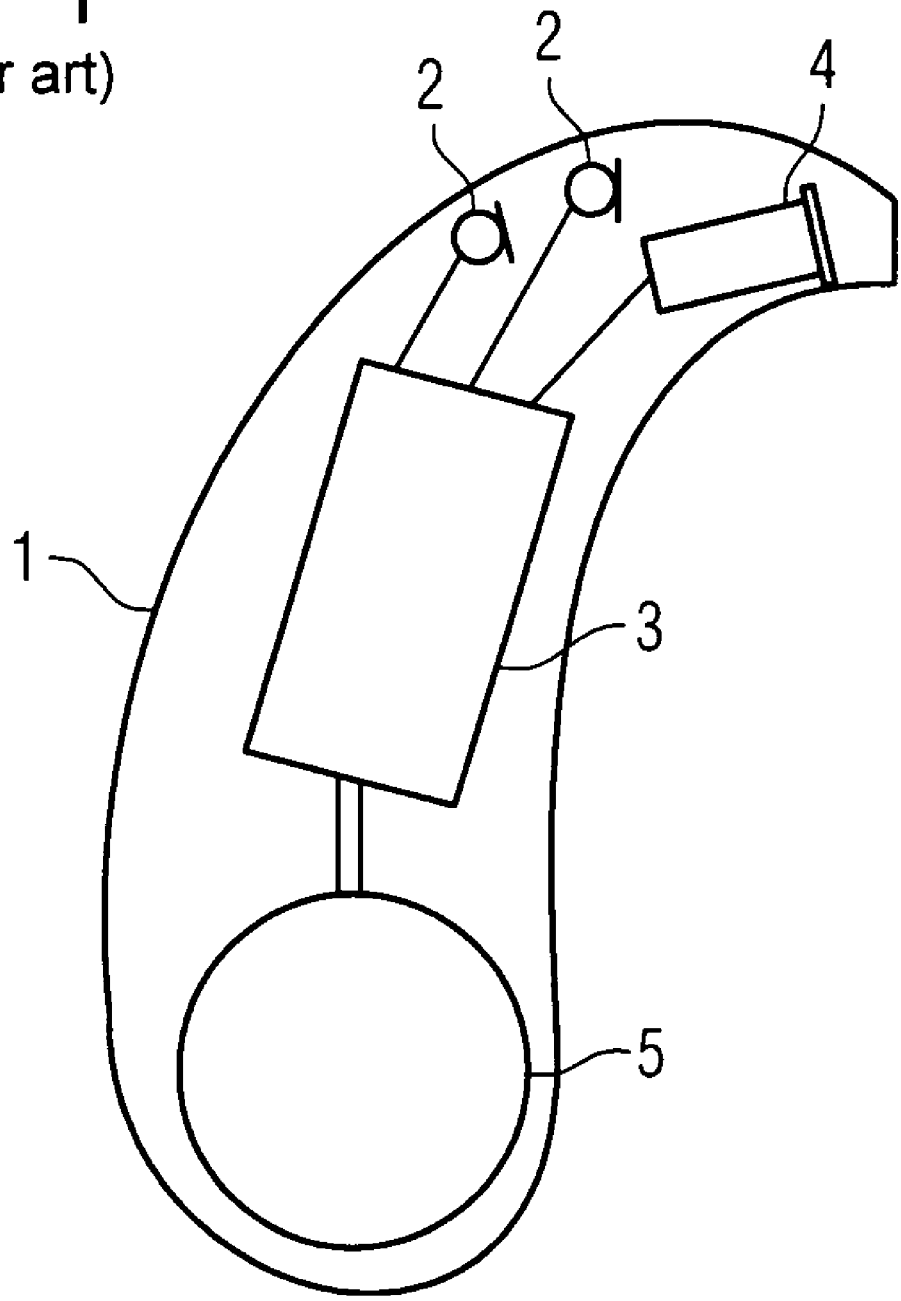
FIG 1 (Prior art)
FIG. 1 schematically illustrates the main components of a hearing aid.
Figure 2:
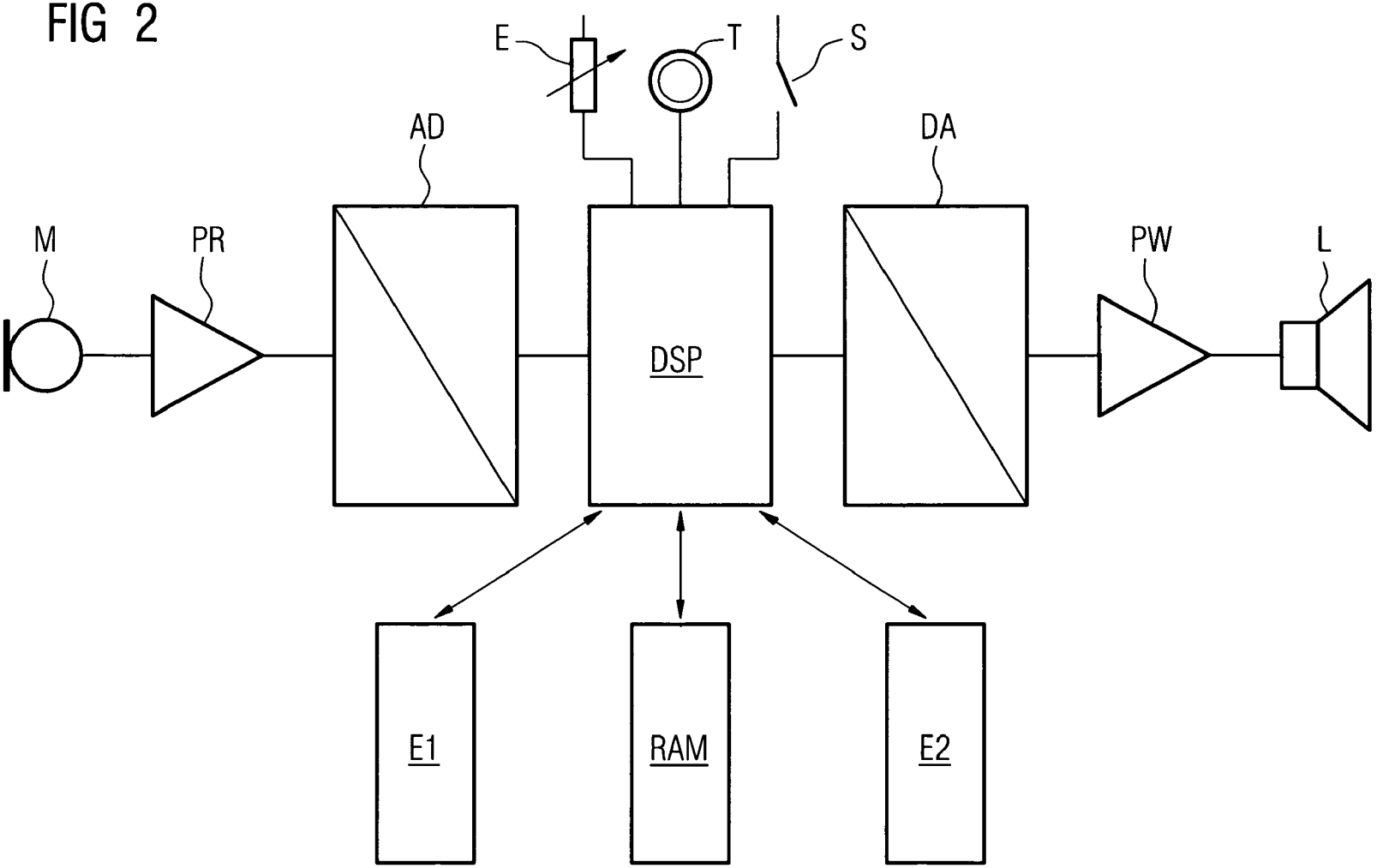
FIG. 2 shows a block diagram of a hearing aid with a resetting device according to the invention.

In the example in FIG. 2 the signal processing chain of a hearing aid is symbolically represented in block diagram form. A microphone M picks up sound signals and a downstream preamplifier PR amplifies the output signals of the microphone M for further processing. An analog-digital converter AD converts the signal into a digital signal for the digital signal processor DSP. For signal outputting, the output signal of the digital signal processor DSP is converted by a digital-analog converter into an analog signal, amplified by a power amplifier PW and finally fed to a loudspeaker for electroacoustic conversion.

The digital signal processor DSP has a random access memory RAM as well as a first nonvolatile memory E1. This memory E1 is here implemented by an EEPROM which can be erased as required. In the memory E1 are stored the individual settings arising e.g. from the fitting of the hearing aid. Specifically, the parameters stored are e.g. in respect of the gain, interference suppression, directional microphone settings, etc. As the memory is nonvolatile, the memory contents are preserved unchanged even if the hearing aid is switched off and on again.

While wearing the hearing aid, the wearer can further refine or improve the setting obtained by the fitting. For this purpose he uses an adjusting device E provided on the hearing aid. The digital signal processor DSP stores each new setting in the memory E1 so that this setting is available when the aid is switched on again.

However, as there are a large number of hearing aid adjustment options constituting a multidimensional space, it happens time and again that a hearing aid is adjusted to the point that the wearer himself is no longer able to return to a setting that is right for him. There is therefore provided, in the hearing instrument according to the invention, an additional memory device E2 in which an individual setting can be stored. If the hearing aid wearer finds a setting to be good or better than previous settings, he therefore transfers the setting values from the memory E1 to the memory E2. This transfer of the memory values is initiated by the hearing aid wearer via appropriate hardware or software using the switch S symbolically indicated in FIG. 2. Whereas the data in the memory E1 is continuously updated automatically depending on the hearing aid design, the data is only transferred from the memory E1 to the memory E2 by manual actuation of the switch S. This ensures that only the adjustment data which the hearing aid wearer has deliberately saved when he is satisfied with the setting is stored in the memory E2.

As soon as the settings are changed further via the adjusting device E on the hearing aid, if the hearing aid wearer is not satisfied with these new settings and wishes to return to a setting which he found to be good and which is stored in the memory E2, he actuates a button T so that the setting data is transferred from the memory E2 to the digital signal processor or more specifically the memory E1 (the actuating device, in this case the button T, is part of the adjusting device). The hearing aid wearer can thus revert to an individual setting which he has himself saved or which was stored during the individual fitting procedure in the memory E2. Restoring a previous setting in this way corresponds to a computer recovery mode whereby the computer can be rolled back to a known good state after a serious loss of data or virus attack.

There are basically two ways of implementing the inventive resetting process in the hearing instrument. As mentioned above, it can be implemented on the one hand by a so-called "hard reset" and, on the other, by a "soft reset". FIG. 2 illustrates the "hard reset" variant. In the case of a "soft reset" the hearing aid wearer possibly has to actuate one or more keys simultaneously or select the appropriate instruction from a menu. According to a particular embodiment of a hearing aid, with the "hard reset" it is possible to return to a non-individual factory setting, whereas with a "soft reset" it is possible to return to an individual setting. The "hard reset" allows the manufacturer to set a defined basic state for troubleshooting. The "soft reset" would then rather be a means of enabling the hearing aid wearer to restore earlier hearing aid settings.

According to another embodiment, the memory E2 provided in addition to the memory E1 in the hearing aid can also be automatically filled with data. In this example such automatic writing of data takes place when the user changes a setting and the last valid setting is shifted into the memory E2. Depending on the size of the additional memory E2, a history of the most recent settings can thus be saved. In this way it is possible to implement a computer-type "undo" function.

Even if the data is not automatically saved in the additional memory E2, it is possible for a setting data history to be stored there. For example, the option exists of storing a data record in the memory E2 whenever the switch S is actuated. The memory E2 then operates e.g. according to the FIFO principle. Thus, for example, the last ten adjustment parameters or rather adjustment parameter sets can be retrievably saved.

The button T with which the setting is reset can be implemented as a separate control on the unit. If a "hard reset" button is additionally provided, a location in the housing of the hearing instrument is usually selected for this purpose. For the "soft reset", a situation button of the hearing instrument is possibly used which is then pressed for e.g. 30 seconds in order to execute the "soft reset". This means that the situation button, which is usually used for switching to directional microphone mode, telephone coil mode, etc., acquires the additional function of resetting the hearing aid settings.

The actuating device, i.e. the button T, can also be part of the adjusting device E. In this case, the old setting value is automatically stored in the memory E2 each time the hearing instrument is readjusted, so that it is available for subsequent retrieval. The same naturally also applies, mutatis mutandis, to complete parameter sets.

With a hearing aid corresponding to the examples described in greater detail above, the user is able to revert to states of adjustment of his hearing instrument in a flexible and independent manner.

The invention claimed is:

1. A hearing instrument, comprising:

an adjusting device for adjusting a parameter of the hearing instrument;

a first memory device for automatically storing the adjusted parameter value for ongoing operation of the hearing instrument;

a second memory device, different from the first memory device, for storing the pre-adjusted parameter value;

an actuating device for manually initiating storing of the adjusted parameter value in the second memory device; and a resetting device for manually resetting first memory device to the pre-adjusted parameter value stored in the second memory device.

2. The hearing instrument as claimed in claim 1, wherein the resetting device comprises a plurality of buttons, and resetting is effected by a key combination of the buttons under software control.

3. The hearing instrument as claimed in claim 1, wherein the resetting device has a button which is pressed for a predefined minimum time for resetting.

4. The hearing instrument as claimed in claim 3, wherein a programming button of the hearing instrument is actuated for the specified minimum time for resetting.

5. The hearing instrument as claimed in claim 1, wherein the memory devices are each implemented as dual EEPROMs.

6. A method for adjusting a hearing instrument, comprising:

storing a parameter value relating to a user setting of the hearing instrument in a first memory device for ongoing operation of the hearing instrument;

storing the parameter value of the hearing instrument in a second memory device separate from the first memory device;

adjusting the parameter value of the hearing instrument;

storing the adjusted parameter value in the first memory device; and manually resetting the adjusted parameter value in the first memory device to the stored parameter value in the second memory device.

7. The method as claimed in claim 6, wherein the resetting is performed by a key combination.

8. The method as claimed in claim 6, wherein resetting is performed by pressing a button for a specified minimum time.

9. The method as claimed in claim 6, further comprises storing the adjusted parameter value in the second memory.

10. The method as claimed in claim 6, wherein the storing of the adjust parameter value in the second memory is initiated by a user via a control on the hearing instrument.

11. A hearing instrument, comprising:

an adjusting device for adjusting a parameter of the hearing instrument, a first memory device for automatically storing the adjusted parameter value for ongoing operation of the hearing instrument a second memory device, different from the first memory device, for automatically storing a history of the adjustment in a first in first out arrangement, a resetting device for manually resetting first memory device to the pre-adjusted parameter value based on the history stored in the second memory device.

12. The hearing instrument as claimed in claim 11, wherein when a plurality of adjustments have been made, the resetting device resets the first memory in reverse order of the adjustments one parameter at a time until reaching a desired setting of the hearing instrument.

* * * * *